United States Patent [19]

Jensen et al.

[11] Patent Number: 4,506,571

[45] Date of Patent: Mar. 26, 1985

[54] MACHINE FOR REMOVING BOOK BINDINGS

[76] Inventors: Robert Jensen, 9 Haylock Ct., Apt. 104, Baltimore, Md. 21236; Richard Jensen, 3411 Lambros Rd., Baltimore, Md. 21234

[21] Appl. No.: 349,784

[22] Filed: Feb. 18, 1982

[51] Int. Cl.[3] ..... B26D 7/06

[52] U.S. Cl. ..... 83/104; 83/157; 83/278; 83/280; 83/925 A

[58] Field of Search ..... 83/104, 157, 277, 278, 83/925 A, 642, 643; 198/773

[56] References Cited

U.S. PATENT DOCUMENTS

| | | | |
|---|---|---|---|
| 2,562,938 | 8/1951 | Moyer | 83/643 X |
| 3,122,041 | 2/1964 | Kile et al. | 83/925 A |
| 3,146,650 | 9/1964 | Sarring et al. | 83/277 X |
| 3,733,947 | 5/1973 | Bryson et al. | 83/925 A |

*Primary Examiner*—James M. Meister
*Attorney, Agent, or Firm*—Howard L. Rose

[57] ABSTRACT

A machine for removing book bindings from books so that the paper comprising the pages of the book can be recycled is provided. The machine includes a front and a rear deck, a pusher, a machine frame which extends above the decks and the pusher and a knife assembly (which includes a knife blade) swingably attached to the machine frame and having an up and a down position. The pusher slides back and forth between in and out positions. A book is placed on the front deck and the pusher slides to its in position, positioning the book under the knife assembly. When the book is properly positioned, the knife assembly swings from the up to the down position, cutting off the binding of the book. In some embodiments the invention includes a table frame upon which the front and rear decks are slidably mounted on railings supported by the table frame and have respective in and out positions. Also, the table frame may support a divider bar which is contacted by the knife blade when the knife assembly is in the down position and which is abutted on its sides by said decks when the decks are in their in positions. Thus, when the decks move to their out positions, spaces are created between the divider bar and the decks on both sides of the divider bar through which the sliced pages and bindings can fall.

24 Claims, 5 Drawing Figures

MACHINE FOR REMOVING BOOK BINDINGS

This invention relates to machines for recycling the paper in books. More particularly, this invention relates to machines for removing the bindings of books so that the paper comprising the pages of the book can be readily recycled.

BACKGROUND OF THE INVENTION

The need to recycle our disposable goods to conserve our natural resources has come to the forefront in the last decade. The great challenge in this effort is to reduce the cost of the recycling so that it is more or at least as economical to recycle as it is to produce the same product from raw materials. One type of goods for which the recycling effort has been successful is the recycling of paper products to reduce the number of trees that must be cut down to produce paper products. This effort to recycle paper comes at a time when the amount of paper products produced and disposed of in the United States, per capita, is increasing.

One paper product which has been found to be ameniable to recycling is paper such as is used in newspapers, magazines, etc. For this reason many communities have undertaken special efforts to collect used paper, including such special efforts as having days set aside in which such paper is picked up at residences separate from the general trash.

Paper from books can also be recycled. However, unlike newspapers and other loose papers which can be recycled without any initial preparation, in recycling books, the first step that must be completed is the removal of the binding from the pages. The binding must be removed first for this reason. When paper is recycled, the ink already printed on the pages must be removed. To accomplish this removal, the paper is put in a special chemical bath that separates and removes the ink. However, when the books are bound, glue is applied to the edges of the pages that are bound together. This glue, if allowed to mix in with the chemicals that are used to remove ink from the pages, disrupts the removal of the ink and thus the recycling effort. It is thus imperative that the binding of books be seperated from the pages of books if the books are to by recycled.

Currently, there are machines in use which perform this function of removing the bindings from books. Some of these machines use band saws to cut the bindings off. However, using band saws is a slow process that creates a relatively unsafe and uncomfortable working environment due to the dust created and the relatively high exposure to injury for the operator of the machines.

Another prior art machine is designed with two cutting blades that are in parallel planes and rub against each other as the blades are brought side-to-side, much like a giant pair of scissors. This machine is also relatively slow and involves a lot of down time as the machine must be finely tuned so that the blades have the correct tolerances with respect to each other.

Thus, it is apparent from the above that there exists a need in the art for a machine which can quickly and efficiently slice the bindings off books without exposing the operators of the machine to unnecessarty risks and without generating a lot of dust.

This invention fulfills this need, along with other needs apparent to the skilled artisan once given the following disclosure:

SUMMARY OF THE INVENTION

Generally speaking, this invention provides a machine for removing a binding of a book comprising a front deck, a pusher located above said front deck and being movable between an in and an out position, a frame member extending alongside and above said decks and said pusher, and a knife assembly including a knife blade swingably attached to said frame member and having two positions, an up and a down position, wherein when said knife assembly swings from the up to the down position said knife blade cuts off the binding of said book, said machine being constructed and arranged such that when said pusher is in its in position said pusher positions said book under said knife assembly.

In some embodiments of this invention the invention includes a rear deck. In these embodiments, the front and rear decks may be slidable between in and out positions. The decks are in their in positions during the portion of the operation of the machine when a book is placed under the knife assembly and when the binding is sliced off. The decks move to their out positions after the book binding has been sliced.

The decks and the pusher can be in the shape of boxes with the bottom surfaces removed. In these embodiments, the pusher can push the book across the top of the front deck until the book is positioned under the knife assembly.

In certain embodiments, the invention includes a table frame which supports railings upon which the front and rear decks are slidably supported. This table frame also can support a divider bar which can be located directly under the knife assembly. The divider bar may serve as the stop means for the front and rear decks in that the decks may abut both sides of the divider bar when the decks are both in their in positions. When this occurs, a flat surface may be formed by the top surfaces of the decks and the divider bar.

In certain embodiments of this invention, the knife assembly includes a knife bar to which the knife blade is attached. The knife bar is in turn swingably attached to said machine frame such that the knife bar and knife blade move in an arc with respect to said machine frame. In these embodiments, the knife bar and the knife blade are both elongated members.

The knife bar may be swingably attached to the machine frame by connecting arms which are rotatably attached to the knife bar and to the machine frame. One of the connecting arms is the drive arm and it extends beyond the machine frame and is rotatably attached to an arm of a hydraulic cylinder. The drive arm is powered by the hydraulic cylinder in an arc around the connection of the drive arm with the frame member. This motion causes the knife bar and knife blade to also swing in an arc with respect to this connection.

The invention includes means for separately powering said decks and said pusher between their respective positions. In addition, a timing mechanism may be included to properly control the machine through the following steps (assuming the decks begin in their respective out positions and the pusher begins in its in position):

(1) First the pusher retracts to its out position and a book is placed in front of the pusher.

(2) Next, the decks move from their out positions to their in positions abutting the divider bar.

(3) The pusher then moves from its out position to its in position, pushing the book directly under the knife assembly.

(4) The knife assembly then swings from its up position to the down position, slicing off the binding, and swings back to its up position.

(5) To complete the cycle, the decks move from their in positions to their cut positions.

This invention has numerous advantages over the prior art including the handling of a higher volume of paper per time unit, exposing the machine operator to less risk of personal injury, providing an operation that creates little paper dust, and of being more durable.

Certain embodiments of the invention will now be described with respect to the figures wherein:

IN THE DRAWINGS

DETAILED DESCRIPTION OF THE DRAWINGS

Figure 1:
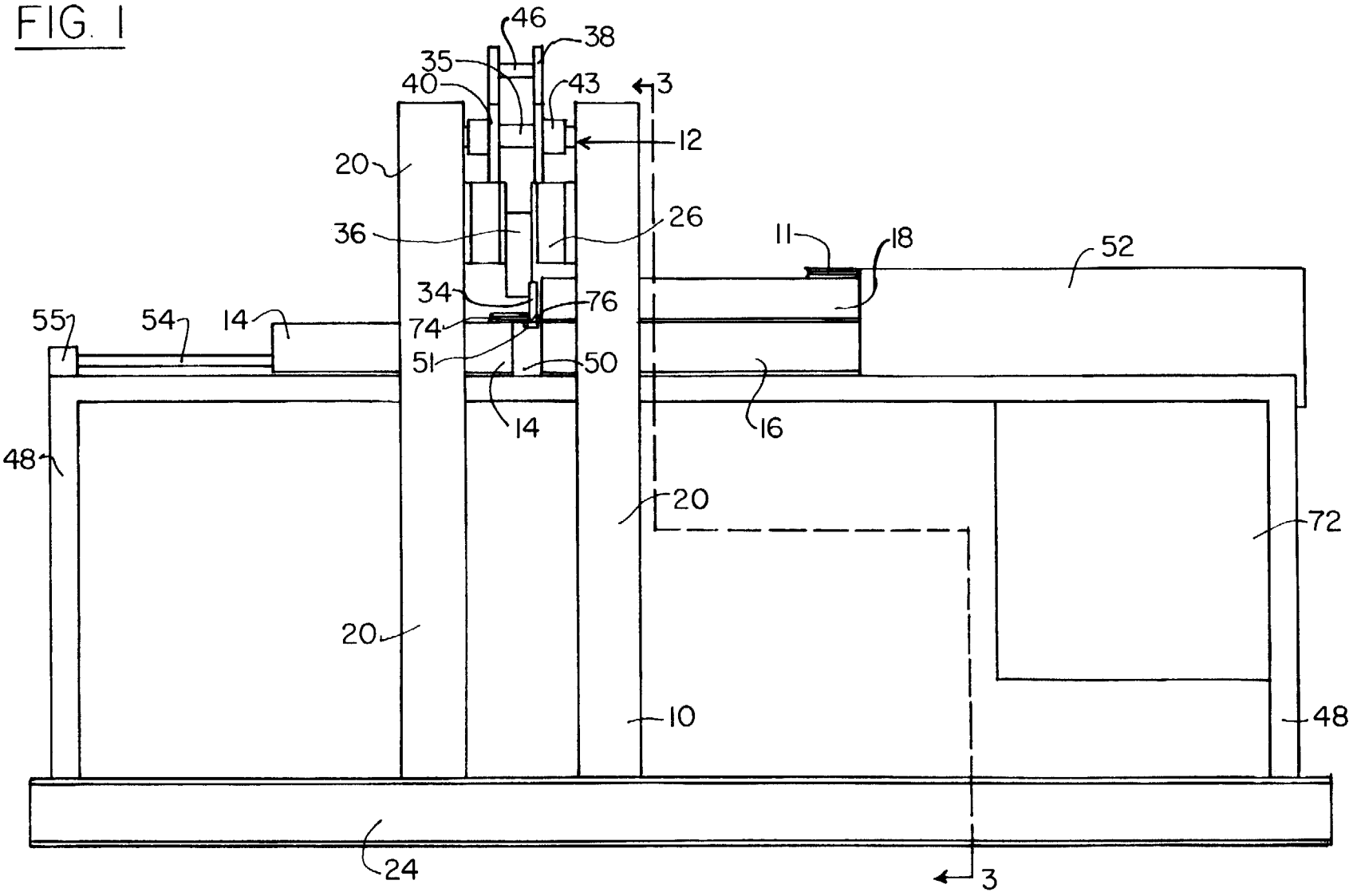
FIG. 1 is a side view of one embodiment of this invention with the hydraulic components and clevis mounting brackets (shown in FIG. 3) removed.

Referring to the Figures, the embodiment illustrated essentially includes machine frame 10, knife assembly 12, rear deck 14, front deck 16 and pusher 18.

Machine frame 10 includes a pair of vertical columns 20 on each side of the machine spaced apart by a distance equal to the width of knife blade assembly 12 (as shown in FIG. 1). Machine frame 10 also includes top horizontal beams 22 which span across and are attached to the top of complementary columns 20. Vertical columns 20 are supported by frame runners 24 which in turn rest on the floor of the work area where the machine is being employed. Columns 20, horizontal beams 22 and frame runners 24 are all I-beams in the embodiment of the invention illustrated in the Figures.

Figure 2:
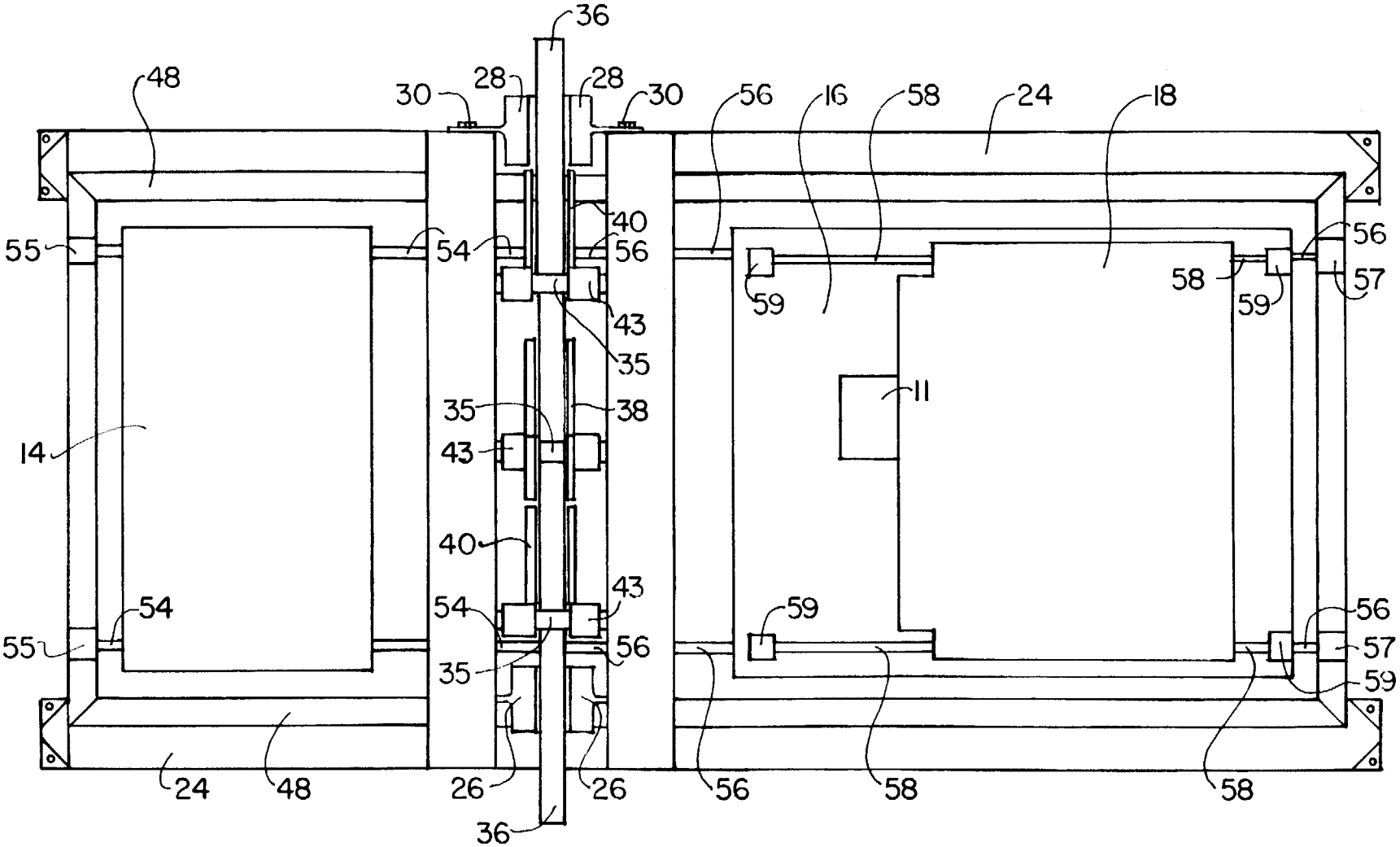
FIG. 2 is a top view of the embodiment of this invention illustrated in FIG. 1 with the hydraulic components and fixed table removed for clarity.
Figure 3:
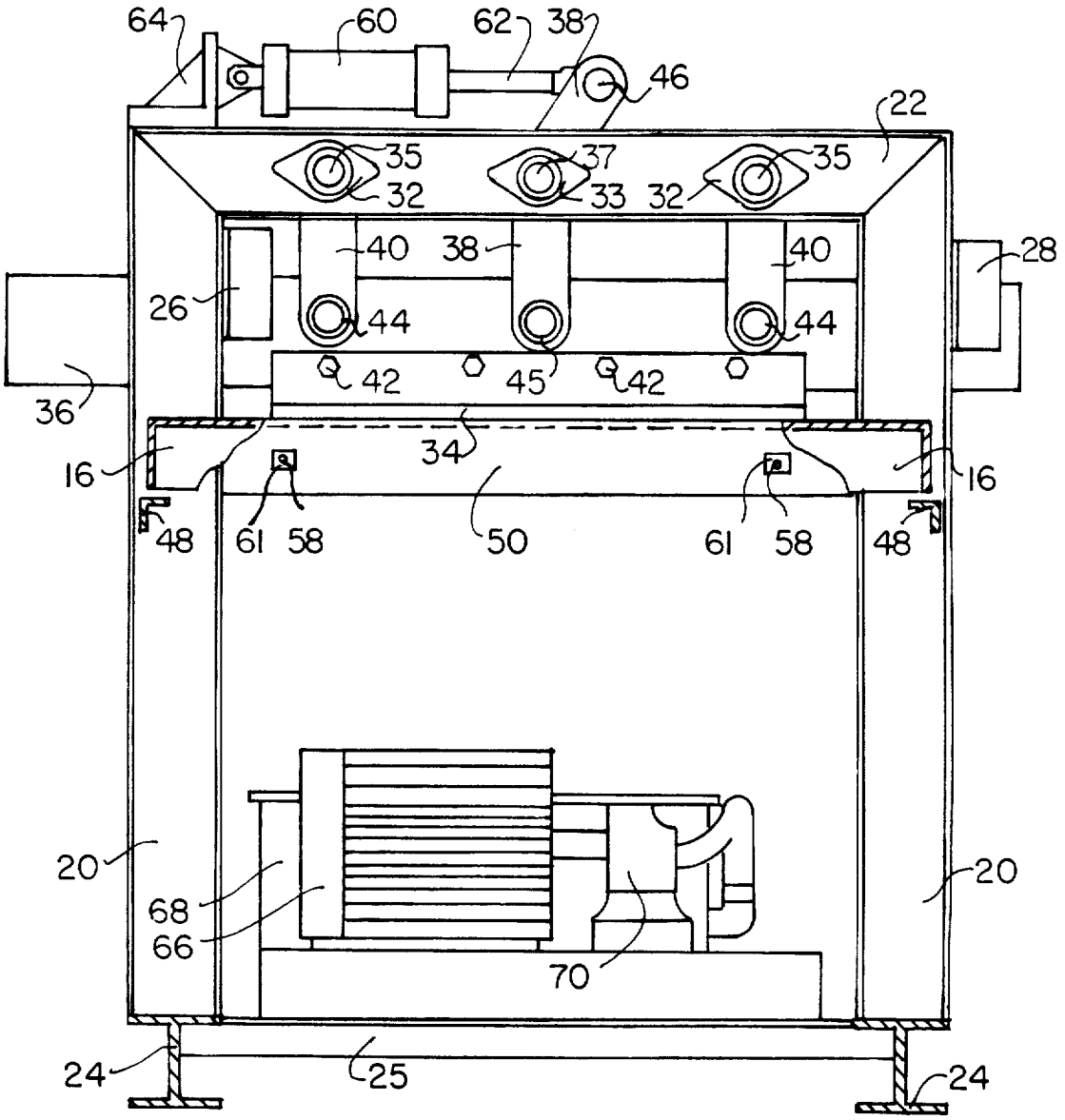
FIG. 3 is a cross sectional view of the embodiment of this invention illustrated in FIGS. 1 and 2 taken along line 3—3 of FIG. 1.

Machine frame 10 also includes inner guide blocks 26 and outer guide blocks 28 which are attached to vertical columns 20 by bolts 30 in the positions shown in FIGS. 2 and 3. The function of guide blocks 26 and 28 is to keep knife assembly 12 in alignment in the vertical when knife assembly is being operated (this operation will be later described in more detail).

In addition to machine frame 10, the following frame members are provided in this embodiment. Located at predetermined spaced intervals across frame runners 24 are cross supports 25. Cross supports 25 extend between and are perpendicular to the frame runners 24 and serve to support selected elements of the machine such as motor 66, reservoir tank 68 and hydraulic pump 70, as shown in FIG. 3. In addition, cross supports 25 give added stability to machine frame 10 and frame runners 24. In the embodiment of the invention shown in the Figures, cross supports 25 are angle irons.

Table frame 48 is another frame member provided for in this embodiment. Table frame 48 consists of four legs, one at each end of the two frame runners 24, and a table-shaped frame connecting the four legs. In other words, table frame 48 looks like a table without a tabletop. In the embodiment of this invention shown in the Figures, all the sections of table frame 48 are angle irons. Table frame 48 serves to support the decks 14 and 16, pusher 18, divider bar 50 and fixed table 52, along with the elements associated with the same.

Knife assembly 12 includes knife blade 34, knife rocker bar 36, drive arm 38 and follower arms 40. Knife assembly 12 is rotatably attached to horizontal beams 22 by shafts 35 and 37, which pass through holes in follower arms 40 and drive arm 38, and flange bearing assemblies 32 and 33, respectively. Shafts 35 and 37 extend between and are attached to flange bearing assemblies 32 and 33, respectively, which are in turn attached to beams 22.

Knife blade 34 is an elongated knife that is attached to knife rocker bar 36 by bolts 42. Knife rocker bar 36 in the embodiment shown in the figures is a rectangular bar with a notch therein along a portion of one of its lower corners which receives knife blade 34. Knife rocker bar 36 is rotatably attached to drive arm 38 and follower arms 40 by rod and bushing assemblies 44 and 45, respectively.

This arrangement of elements allows knife rocker bar 36 to swing in an arc, defined by drive arm 38 and follower arms 40, with respect to horizontal beams 22.

Follower arms 40 are straight plates that extend between shafts 34 and rod and bushing assemblies 44. Drive arm 38 is a dog-leg shaped plate extending between rod and bushing assembly 45 and hydraulic rod connection 46. The connection of drive arm 38 to horizontal beam 22 (flange bearing assembly 33) is located at the bend in the dog-leg. Drive arm 38 and follower arms 40 have collars 43 attached thereto than encompass shafts 36 and 37 to provide more stability to the assembly.

As previously discussed, table frame 48 supports rear deck 14, front deck 16, pusher 18, divider bar 50 and fixed table 52. Rear deck 14, front deck 16 and pusher 18 are supported by table frame 48 as follows.

Railings 54 and 56 are supported at one end by rear railing support blocks 55 and front railing support blocks 57, respectively, which are attached to table frame 48 in the locations shown in FIG. 2. The other ends of railings 54 and 56 are supported by divider bar 50. Rear deck 14 and front deck 16 are supported by railings 54 and 56, respectively, and move back and forth on railings 54 and 56 on linear bearings which are provided between decks 14 and 16 and railings 54 and 56.

Pusher 18 rides on the top of front deck 16 on railings 58. Railings 58 are supported by pusher railing support blocks 59 which are attached to the top of front deck 16 in the locations shown in FIG. 2.

Figure 5:
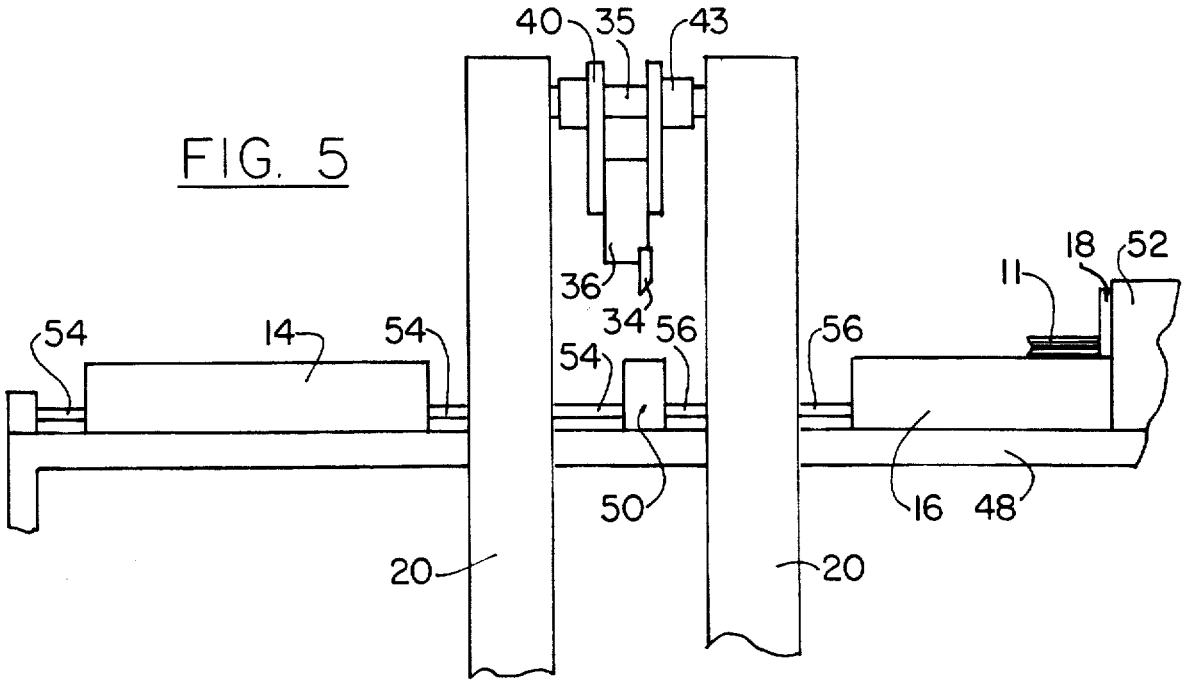
FIG. 5 is a partial side view of the embodiment of this invention illustrated in FIGS. 1–4 showing the knife assembly in the up position and the decks in the out position.

Rear deck 14 and front deck 16 have two basic positions which they slide back and forth between during the operation of this embodiment; in positions as shown in FIG. 1 which is the position the decks 14 and 16 are in when knife assembly 12 goes thru the cutting motion, and out positions which are shown in FIGS. 2 and 5.

Figure 4:
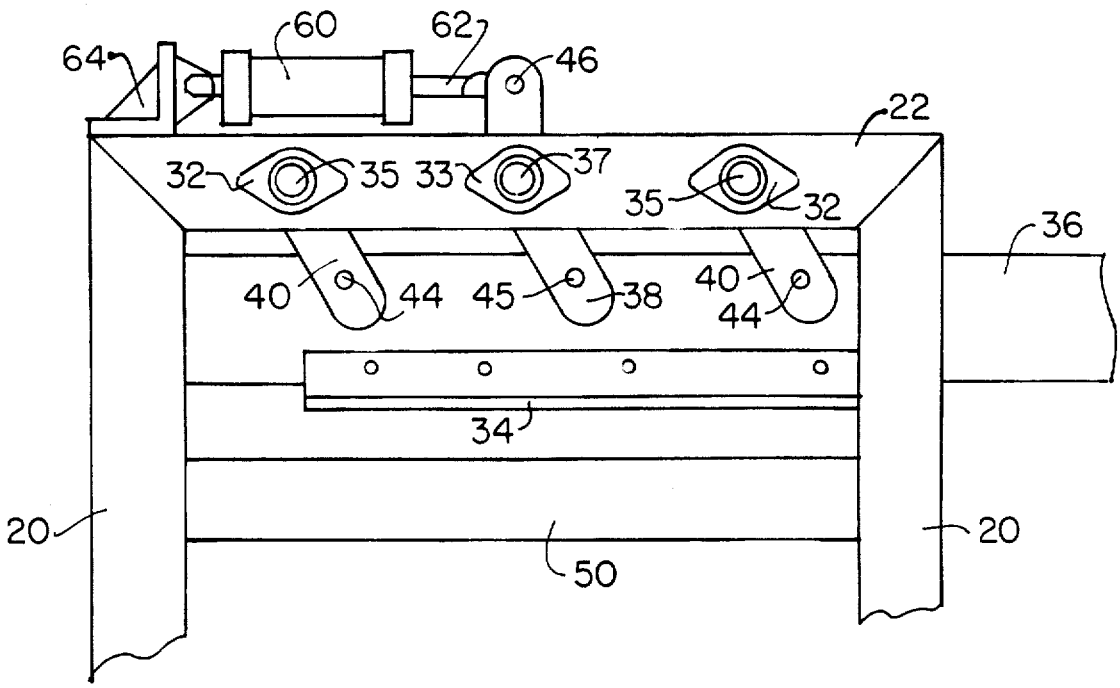
FIG. 4 is a partial front view of the embodiment of this invention illustrated in FIGS. 1–3 showing the knife assembly in the up position.

Pusher 18 also has two basic positions, an in position and an out position, which it slides back and forth between. The in position is when pusher 18 has pushed book 11 in the position to be sliced (as shown in FIG. 1), and the out position is as shown in FIGS. 2 and 4.

In the embodiment of the invention illustrated in the Figures, decks 14 and 16 and pusher 18 are shaped like hollow boxes with the bottom surfaces removed.

If desired, shields can be placed on top of table frame 48 between adjacent columns 20 to cover up the ends of divider bar 50 and the front portions of rear and front decks 14 and 16 when they are in the in positions. These shields will improve the safety of the machine as well as prevent the pages and bindings of the book from falling out the sides of the machine after the book has been sliced.

Fixed table 52 is attached to table frame 48 and acts as a housing for the mechanisms required to power front deck 16 and pusher 18 and for the back sections of front deck 16 and pusher 18. Fixed table 52 also serves as a place for putting the books which are to be sliced by the machine and plays a role in positioning book 11 in front of pusher 18 as will be discussed below in more detail.

Divider bar 50 is a rectangular bar which serves as a divider between front deck 16 and rear deck 14. When decks 14 and 16 are in their in positions, they abut divider bar 50, one on each side of divider bar 50, and form a flat surface with divider bar 50. Divider bar 50 has stick 51 embedded therein. Stick 51 is an elongated piece of hard plastic in the embodiment of this invention illustrated in the Figures. Stick 51 serves as the contact point for knife blade 34 when knife blade 34 slices through a book.

Attached to the top of machine frame 10 is hydraulic cylinder 60 having an arm 62. The end of the hydraulic cylinder 60 opposite arm 62 is attached to clevis mounting bracket 64, which is in turn attached to horizontal beams 22. The end of arm 62 extending away from cylinder 60 is rotatably attached to drive arm 38 by hydraulic rod connection 46.

The power mechanism for hydraulic cylinder 60 is motor 66, reservoir tank 68 and hydraulic pump 70 located on a cross support 25. There is, of course, a fluid line running between hydraulic pump 70 and hydraulic cylinder 60 even though such is not shown in the Figures.

Front deck 14, rear deck 16 and pusher 18 are all powered by conventional air cylinders (not shown in the drawings). These air cylinders can be located under each of these components since these components can be in the shape of hollow boxes having no bottom surfaces as discussed above.

The air cylinders and hydraulic pump 70 are connected to control box 72. Within control box 72 are two cams and two microswitches for each air cylinder and the hydraulic pump 70. The cams and microswitches act as the timing and activating mechanism for the air cylinders and the hydraulic pump. The cams are located on a cam shaft which is powered by a small geared head motor. As the cam shaft rotates, the cams activate microswitches which send signals to the solenoids which in turn activate the cylinders in the proper sequence.

The embodiment of this invention illustrated in the Figures is employed and operated as follows. Book 11, which is to be recycled, is placed on pusher 18 in the position shown in FIG. 1 with its binding up against fixed table 52. Note that at this time, pusher 18 and decks 14 and 16 are in their in positions and knife assembly 12 is in its down position. Also note that a book has just been sliced by knife blade 34 and is now in two pieces, pages 74 and binding 76. Pusher 18 is then slid along railings 58 to its out position. The next step in the operation is that decks 14 and 16 are slid along railing 54 and 56 from their in positions to their out positions (shown in FIGS. 2 and 4) and knife assembly swings from its down position (shown in FIGS. 1 and 3) to its up position (shown in FIGS. 4 and 5). When this occurs, pages 74 and binding 76 fall thru the holes in table frame 48 adjacent divider bar 50 onto conveyors, carts, binds, etc. located below the holes. When rear and front decks 14 and 16 are retracted all the way to their out positions pusher 18 remains stationary with respect to front deck 16, and is pulled back approximately even with the front edge of fixed table 52 (see FIG. 4), causing book 11 to fall in front of pusher 18.

Rear deck 14 and front deck 16 are then moved to their in positions until their front edges abut divider bar 50 as shown in FIG. 1. Next, pusher 18 is slid forward, pushing book 11 along the top of front deck 16 until book 11 is under knife assembly 12. Hydraulic cylinder 60 is then activated driving arm 62 from the retracted position shown in FIG. 4 to the extended position shown in FIG. 3. This movement rotates drive arm 38 around shaft 37 (and thus causing follower arms 59 to rotate around shafts 35), swinging knife assembly 12 from its up position to its down position, slicing book 11. Pusher 18 is then retracted to the position shown in FIG. 1, completing the cycle.

Once given the above disclosure, many other embodiments, improvements and modifications of this invention will become apparent to the skilled artisan. Such other embodiments, improvements and modifications are considered to be within the scope of this invention as defined by the following claims:

I claim:

1. A machine for removing a binding of a book comprising:

a deck, a pusher located above said deck and being movable between an in and an out position, a frame member extending alongside and above said deck and said pusher, and a knife assembly including a knife blade swingably attached to said frame member and having two positions, an up and a down position, wherein when said knife assembly swings from the up to the down position said knife blade cuts off the binding of said book, said machine being constructed and arranged such that when said pusher is in its in position said pusher positions said book under said knife assembly, said deck including a front and a rear deck, said front deck and said rear deck being slidable between in and out positions, said decks being in their said in positions when said book is placed under said knife assembly.

2. A machine according to claim 1 wherein said front deck, said rear deck and said pusher are members having flat horizontal top surfaces, said book being in front of said pusher when said book is positioned under said knife assembly.

3. A machine according to claim 2 further comprising;

a table frame and first railings attached to said table frame, said front deck and said rear deck being slidably supported by said first railings.

4. A machine according to claim 3 wherein said front deck, said rear deck and said pusher are box-like in shape with the bottom faces removed.

5. A machine according to claim 3 further comprising;

a divider bar, said divider bar being supported by said table frame directly under said knife assembly, wherein when said decks are in their in positions said decks abut said divider bar, one on each side of said divider bar, and wherein when said decks are in their out positions, the decks are spaced from said divider bar.

6. A machine according to claim 5 wherein said first railings are also supported on one end by said divider bar.

7. A machine according to claim 6 further comprising second railings supported by said front deck, wherein said pusher is slidably supported by said second railings.

8. A machine according to claim 7 wherein said frame members includes a first horizontal beam member and two vertical columns supporting said first horizontal beam member, said first horizontal beam member being above said decks and said pusher, said knife assembly being rotatably attached to said horizontal beam member.

9. A machine according to claim 8 further comprising a second horizontal beam member spaced horizontally from said first horizontal beam member wherein said knife assembly is between and rotatably attached to said first and second horizontal beam members.

10. A machine according to claim 9 wherein said knife assembly includes;

a knife bar, and connecting arms extending between and being rotatably attached to said horizontal beams and said knife bar, wherein said knife blade is attached to said knife bar.

11. A machine according to claim 10 wherein said knife blade is elongated and said knife bar is an elongated rectangular member having a length longer than said knife blade.

12. A machine according to claim 11 wherein said knife assembly is constructed and arranged such that said knife bar and said knife blade move in an arc with respect to said horizontal beams when said knife assembly is swung between its up and down positions.

13. A machine according to claim 12 wherein said knife bar and said knife blade remain horizontally parallel to said divider bar at all times during the operation of the machine.

14. A machine according to claim 13, further comprising;

a hydraulic cylinder having an arm, said hydraulic cylinder being attached to said frame member, wherein one of said connecting arms is a drive arm which extends up beyond the horizontal beams and is connected to said arm of said hydraulic cylinder, wherein the position of said hydraulic cylinder arm determines the position of said knife assembly.

15. A machine according to claim 14 wherein said knife blade contacts said divider bar when said knife assembly is in the down position.

16. A machine according to claim 15 wherein said divider bar has embedded therein a hard plastic strip, said hard plastic strip being contacted by said knife blade when said knife assembly is in the down position.

17. A machine according to claim 16, further comprising a fixed table fixedly attached to said table frame in a position such that said pusher is under said fixed table when said pusher is in its out position and said front deck is in its out position.

18. A machine according to claim 17, further comprising;

means for separately powering said decks, said pusher, and said hydraulic cylinder, timing means connected to said powering means for determining when and which of said powering means is activated.

19. A cascade feeder and bound material chopping assembly for use in severing the spine from the bound material, said assembly comprising:

at least first and second generally parallel reciprocatable decks, said first deck overlying said second deck and having a downwardly extending dam at a front edge thereof;

a cutter assembly having a reciprocatable cutter blade and a cooperating cutter stick, said second deck being movable to position a front edge of said second deck adjacent a first side of said cutter stick;

a third reciprocatable deck generally parallel to said first and second decks and having a front edge positionable adjacent a second opposed side of said cutter stick; and means to reciprocate said decks so that the bound material which is placed on said first deck is fed to said cutter by movement of said first and second decks for severance of the spine from the bound material and further so that the spineless bound material is removed from said cutter by said third deck.

20. A machine for removing a binding of a hook comprising:

a deck, a pusher located above said deck and being movable between an in and an out position, a frame member extending alongside and above said deck and said pusher, and a knife assembly including a knife blade swingably attached to said frame member and having two positions, an up and a down position, a table frame, a divider bar, said divider bar being supported by said table frame directly under said knife assembly, wherein when said knife assembly swings from the up to the down position said knife blade cuts off the binding of said book, said machine being constructed and arranged such that when said pusher is in its in position said pusher positions said book under said knife assembly, said knife assembly including a knife bar and connecting arms, said frame member including at least one horizontal beam spaced above the deck, said connecting arms extending between and being rotatably attached to said horizontal beams and said knife bar, said knife blade being attached to said knife bar, said knife assembly being constructed and arranged such that said knife bar and said knife blade move in an arc with respect to said horizontal beam when said knife assembly is swung between its up and down positions, wherein said knife blade remains horizontally parallel to said divider bar at all times during the operation of the machine.

21. A machine according to claim 20 wherein the connecting arms are all of equal length.

22. A machine according to claim 21 wherein said deck includes a front and a rear deck, said front deck and said rear deck being slidable between in and out positions, said decks being in their said in positions when said book is placed under said knife assembly.

23. A machine according to claim 22, wherein when said decks are in their in positions said decks abut said divider bar, and wherein when said decks are in their out positions, the decks are spaced from said divider bar.

24. A machine according to claim 23, further comprising:

a hydraulic cylinder having an arm, said hydraulic cylinder being attached to said frame member, wherein one of said connecting arms is a drive arm which extends up beyond the horizontal beam and is connected to said arm of said hydraulic cylinder, wherein the position of said hydraulic cylinder arm determines the position of said knife assembly.

* * * * *